US006467540B1

(12) United States Patent
Weinig et al.

(10) Patent No.: US 6,467,540 B1
(45) Date of Patent: Oct. 22, 2002

(54) COMBINED SEALING AND GRIPPING UNIT FOR RETRIEVABLE PACKERS

(75) Inventors: Conrad Gustav Weinig, Missouri City; John Lindley Baugh, Houston, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 20 days.

(21) Appl. No.: 09/598,830

(22) Filed: Jun. 21, 2000

(51) Int. Cl.[7] ..... E21B 23/01
(52) U.S. Cl. ..... 166/120; 166/217; 166/138
(58) Field of Search ..... 166/138, 120, 166/123, 217; 272/339

(56) References Cited

U.S. PATENT DOCUMENTS

| | | | | | |
|---|---|---|---|---|---|
| 2,241,561 | A | * | 5/1941 | Spencer | 166/13 |
| 2,714,932 | A | * | 8/1955 | Thompson | 166/119 |
| 2,715,441 | A | * | 8/1955 | Bouvier | 166/127 |
| 2,822,874 | A | * | 2/1958 | Brown | 166/119 |
| 3,000,443 | A | | 9/1961 | Thompson | |
| 3,062,291 | A | | 11/1962 | Brown | |
| 3,142,338 | A | | 7/1964 | Brown | |
| 3,948,321 | A | * | 4/1976 | Owen et al. | 166/277 |
| 4,018,272 | A | | 4/1977 | Brown et al. | |
| 4,432,418 | A | * | 2/1984 | Mayland | 166/133 |
| 4,441,559 | A | * | 4/1984 | Evans et al. | 166/120 |
| 4,749,035 | A | | 6/1988 | Cassity | |
| 4,898,245 | A | * | 2/1990 | Braddick | 166/387 |
| 5,330,001 | A | * | 7/1994 | Baugh et al. | 166/138 |
| 5,542,473 | A | | 8/1996 | Pringle et al. | |
| 5,775,429 | A | | 7/1998 | Arizmendi et al. | |
| 6,276,690 | B1 | * | 8/2001 | Gazewood | 277/336 |

* cited by examiner

*Primary Examiner*—David Bagnell
*Assistant Examiner*—Daniel P Stephenson
(74) *Attorney, Agent, or Firm*—Madan, Mossman & Sriram, P.C.

(57) ABSTRACT

A wellbore packer and slip combination for production tubing and the like comprises a plurality of slip elements that are caged together around the periphery of a cylindrical mandrel. An axially displaced actuator simultaneously engages all of the elements to ramp one end of all elements against a casing wall. After the one end of the slip and packer unit is set, further displacement of the actuator expands the other end of the elements against the casing wall. The packer and slip assembly may be retracted and recovered by a simultaneous lift and rotation of the tool string.

10 Claims, 4 Drawing Sheets

COMBINED SEALING AND GRIPPING UNIT FOR RETRIEVABLE PACKERS

BACKGROUND OF THE INVENTION

1. Field of the Invention

The present invention relates to the art of well drilling and earth boring. More particularly, the invention relates to packer devices for closing annular space between well tubing and well casing or the borehole wall.

2. Description of Related Art

Well production tubing, for example, is surrounded by an annular space between the exterior wall of the tubing and the interior wall of the well casing or borehole wall. Frequently, it is necessary to seal this annular space between upper and lower portions of the well depth. Appliances for accomplishing the sealing function are known in the well drilling arts as "packers". Traditionally, the sealing element of a packer is a ring of rubber or other elastomer that is in some manner secured and sealed to the interior well surface which may be the interior casing wall or the raw borehole wall. By compression or inflation, for example, the ring of rubber is expanded radially against the casing or borehole wall.

As an incident to the sealing function of a packer, the annular space sealing apparatus must be secured at the required position along the well length. The position securing operation is characterized in the art as "setting". Packers are usually set by a mechanism known to the art as a "slip". Slips are wedging devices in which a pair of ramped or tapered surfaces are mutually engaged to increase the combined dimension of radial thickness. Resultantly, a hardened surface penetration element such as serrated edges, teeth or diamond points are, by an axially directed force such as by hydraulic pressure or screw threads, pressed radially into a surrounding casing wall or borehole wall.

With but few exceptions, packer and slip devices are separately placed and engaged. Consequently, the physical size and length of a prior art tool string is long and expensive. Since each device is engaged separately, the complete engagement procedure is protracted. It is, therefore, an object of the present invention to combine the gripping and sealing elements of a downhole tool into one unit that is deployed in one procedural operation.

Another object of the present invention is a well packer unit that is shorter and requires less total movement or stroke for actuation. Shorter tool length also facilitates downhole placement and borehole navigation through tight borehole positions.

Also an object of the invention is a gripping/sealing tool having relatively few component parts that are less expensive to manufacture, require less interaction between the cooperative elements and allows an inventory reduction.

A further object of the invention is a symmetrical gripping/sealing system that may be set from either direction thereby making it possible to use many of the same components for a wireline set device (set from above) and a hydraulically set device (set from below).

Other advantages of the invention include a substantial elimination of body movement during actuation thereby permitting hydraulically set tools to be set more closely to one another without affecting the tubing or the other tools. Moreover, the invention gripping features extend substantially around the entire circumference of the tool thereby spreading the gripping forces more evenly across the casing ID and directly into the casing wall.

SUMMARY OF THE INVENTION

These and other objects of the invention are accomplished by a plurality of wicker faced slip elements that are loosely aligned around the perimeter of a cylindrical mandrel as sectors of a cylinder. Each slip element is saddle-shaped with the wicker faces on both ends and a saddle seat in between. A full-circle caging ring has an inside diameter sufficient to slide over the O.D. of a cylindrical tool mandrel. A plurality of axially oriented slots cut radially into the caging ring from the I.D. span the slip element saddle seats to loosely confine the respective slip elements. A peripheral slot from the I.D. around the middle of the caging ring accommodates a belt spring that biases the slip elements collectively against a cylindrical body surface. Full circle packer seals fitted around deformable metal base rings fit, collectively, over both ends of the slip elements. The slip element assembly is confined between two, oppositely facing ramps. One ramp is integral with to the tool body. The other ramp is advanced axially toward the fixed first ramp by a sliding push ring. The push ring is driven by an axially directed force such as hydraulic pressure or a threaded lead advance. The push ring directly engages a plurality of keys that are confined in slots to axial movement. Each key is secured to the caging ring by a threaded, set-screw type of shear fastener. The caging ring bears directly upon the saddle seat wall of each slip element. Consequently, upon initial advancement of the push ring, the entire assembly slides axially as a unit against the fixed ramp. Further advancement of the push ring slides the slip element end that is contiguous with the fixed ramp along and radially out from the fixed ramp to engage inside surface of a well casing.

Continued closure of the sliding ramp toward the fixed ramp shears the fasteners between the slip elements and the caging ring. Thereby released, the sliding ramp may advance under the other end of the slip element and wedge it radially against the casing I.D.

The slip and packer seal assembly may be retracted and recovered by a simultaneous lifting and rotation of the tool string.

BRIEF DESCRIPTION OF THE DRAWINGS

Preferred embodiments of the invention are described by reference to the drawings wherein like reference characters are used to describe like or similar elements throughout the several figures of the drawings and.

DESCRIPTION OF THE PREFERRED EMBODIMENTS

Figure 1:
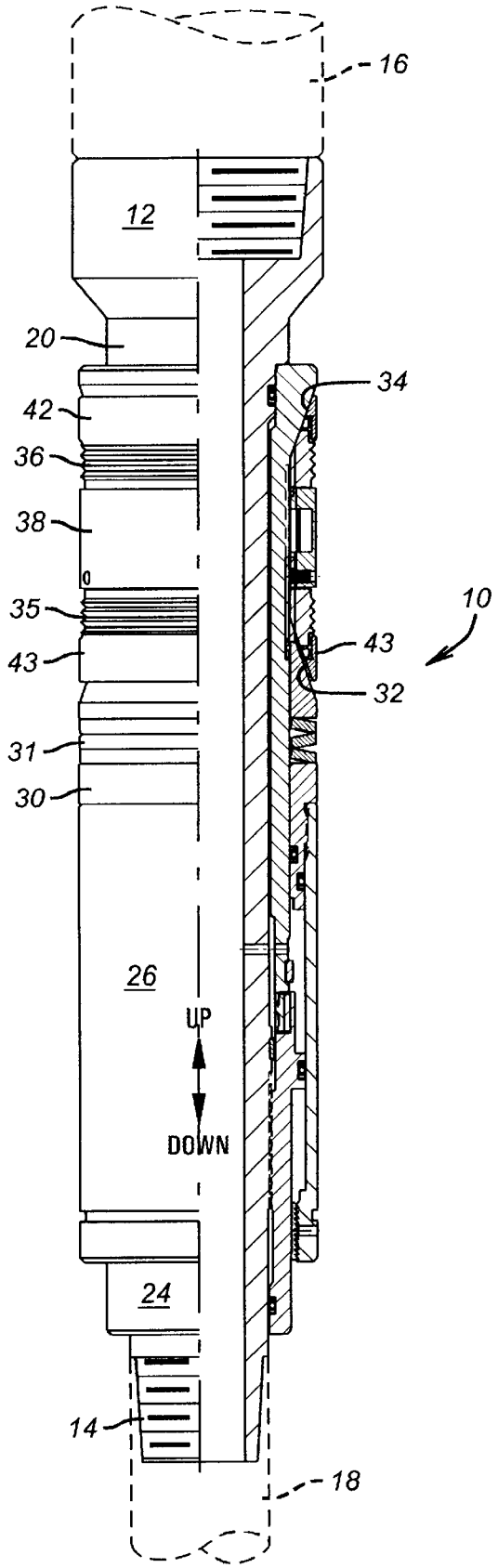
FIG.1 is an orthographic elevation of the invention in assembly with downhole tubing.

The elevation view of FIG. 1 illustrates the invention in a downhole environment as a intermediate tool sub 10 near the bottom end of a tubing string 16 and above a downhole operational tool 18. The central core of the invention 10 is a mandrel 20 having an integral joint box 12 at the upper end and a pin 14 at the lower end. Traditional with industry convention, the box 12 carries an internal tapered thread and the pin 14 carries an external tapered thread.

Between the box 12 and pin 14, the mandrel is turned to provide a stepped abutment face 23 and a closely proximate O-ring seal channel 66. Further down the mandrel length are one or more fluid flow ports 21 that traverse the mandrel wall. Below the fluid flow ports 21 is an inner pickup ring 52 that preferably circumscribes the mandrel. Below the pickup ring 52 is an assembly thread 44.

Concentrically overlying the substantially cylindrical mandrel 20 and in juxtaposition with the abutment face 23 is a tool body 22 having a conical ramp 34 at the upper end and longitudinal splines 49 around the lower end. Adjacently above the splines 49 is an outer pickup ring 50 that circumscribes the tool body 22. Above the pickup ring 50 are one or more fluid flow ports 27 that penetrate the tool body wall. The outer turned surface of the body below the conical ramp 34 is cut by a plurality of shallow, longitudinal key slots 72 that are spaced substantially equally around the tool body circumference.

Also concentrically overlying the mandrel 20 below the tool body 22 is an annular piston 24 having mating end splines 49 for an axial slip fit with the splines 49 of the tool body 22. Below the end splines 49 is a circumferential rib 29 that carries an O-ring seal 58. The lower end of the piston 24 carries an internal O-ring 64 that seals with the outer surface of the mandrel 20. Approximately midway between the ends of the piston 24 are internal assembly threads 44 that mate with corresponding threads on the mandrel 20. The outer surface of the piston 24 carries external ratchet threads 62 to receive a body lock ring 28 having internal ratchet threads to match threads 62 on the piston surface.

Concentrically overlying the piston 24 is a cylinder 26 having the lower end thereof secured by assembly threads 60 to the body lock ring 28. The upper end of the cylinder 26 is attached by assembly threads 47 to a push ring 30. The internal volume of a fluid pressure chamber 46 is sealed by O-rings 54, 56, 58, 64 and 66.

Oppositely, below the ramp face of the upper cone 34 is a sliding conical sleeve 32. A pressure face of the sleeve 32 is separated from the pressure face of the push ring 30 by a plurality of ring springs 31. Between the opposing ramp faces is the packer seal 42 and slip 35 assembly.

Figure 2:
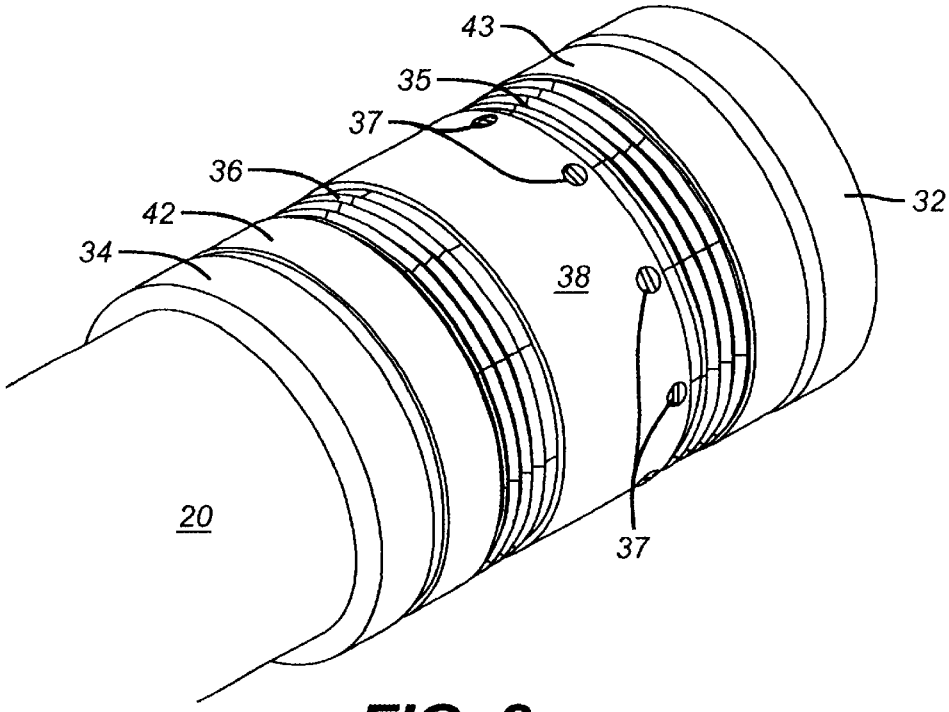
FIG. 2 is an isometric view of the slip and packer section of the invention.
Figure 3:
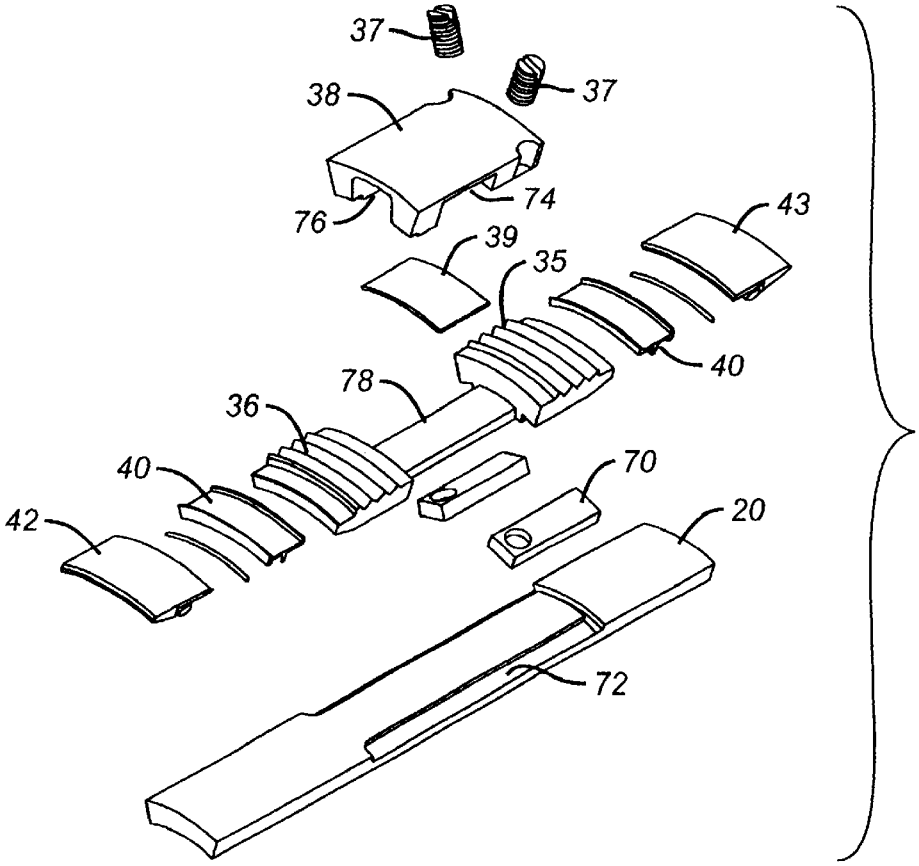
FIG. 3 is an exploded assembly section of the invention.

With respect to FIGS. 2 and 3, in particular, the internal geometry of a circumferential cage ring 38 includes a circumferential belt slot 74. At uniform angular stations around the internal circumference of the cage ring 38 are a plurality of longitudinal saddle slots 76. Each of the saddle slots 76 receives the bridging bar 78 of a slip set 35. Each slip set includes a pair of wickers (teeth) 36; a wicker set at each end of the bridging bar 78. The opposite distal ends of the slip sets mesh with full circle packer seals 42 and 43 comprising elastomer or rubber rings molded to deformable metal rings 40. A circular belt spring 39 traverses the belt slot 74 and overlies the slip set bridging bars 78 to bias the slip sets 35 against the outer surface of the tool body 22. Keys 70, respective to each of the slots 72 and the number of slip sets 35, are attached directly to the cage ring by shear screws 37.

Figure 4:
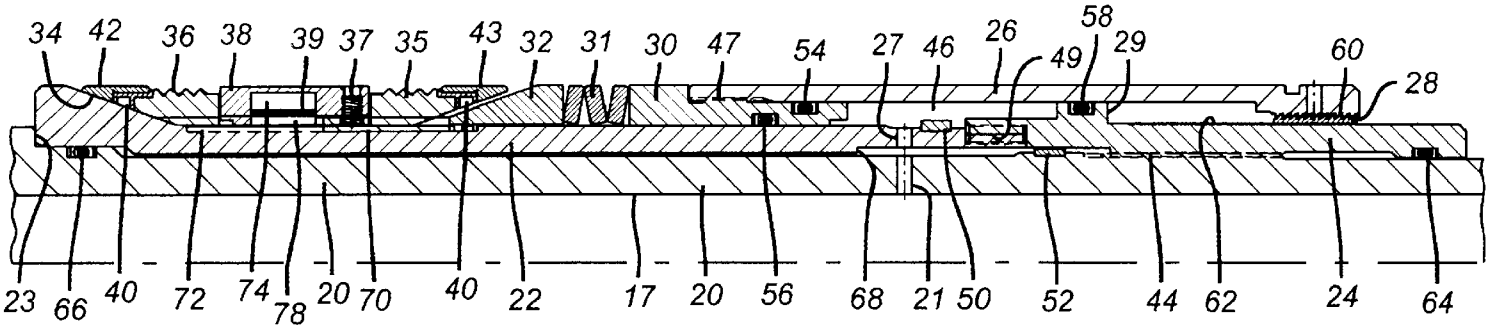
FIG. 4 is a half cylinder section of the invention at an initial setting for running into a well.

Relative to FIG. 4, the invention is prepared for downhole deployment with the cylinder 26 and push ring 30 retracted from the slip sets 35. The body lock ring 28, in fixed assembly with the lower end of the cylinder 26, is turned along the ratchet threads 62 to the desired position that places the cooperative train of components in loosely assembled contact.

Figure 5:
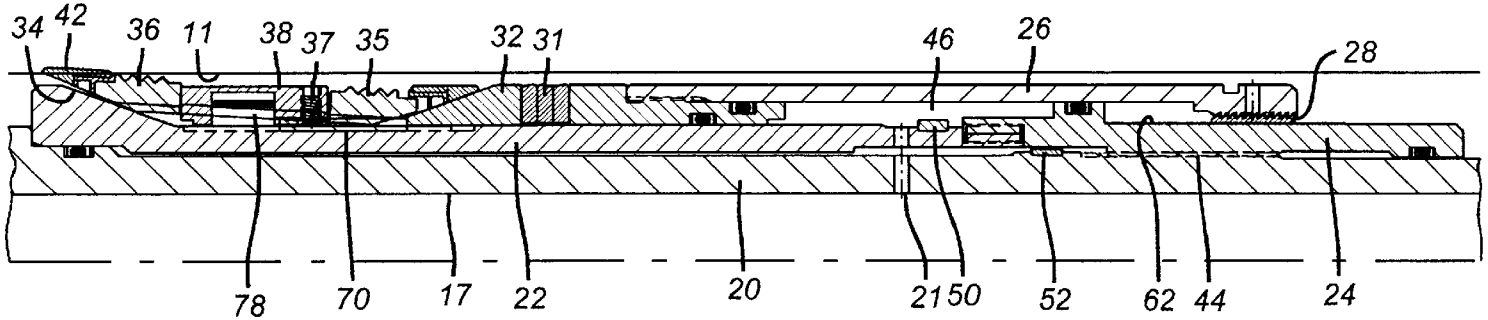
FIG. 5 is a half cylinder section of the invention at a partially deployed setting.

When located at the desired downhole position, the internal bore of the upper tubing string 16 is pressurized to transmit fluid pressure to the internal bore 17 of the mandrel 20. Fluid pressure within the mandrel bore 17 is further transmitted through the fluid flow ports 21 and 27 into the pressure chamber 46. Pressure forces within the chamber 46 are exerted upon the internal edge of the push ring 30 thereby advancing the push ring against the prestress of ring springs 31. Collapse of the ring spring prestress drives the component train against the lower cone 32 and the cone 32 into the lower edge of the keys 70. The keys 70 are structurally linked to the cage 38 by the shear screws 37. Consequently, displacement of the keys 70 along the key slots 72 in the tool body 22 drives the cage 38 against the upper wicker set 36 and upper packer seal 42 along the ramp of upper cone 34 as shown by FIG. 5. Simultaneously, the body lock ring 28 is forcibly advanced over the rachet threads 62 which are ratchet biased to allow overhaul slippage of the body locking ring 28 in the up-hole direction but to oppose overhauling in the down-hole direction.

Figure 6:
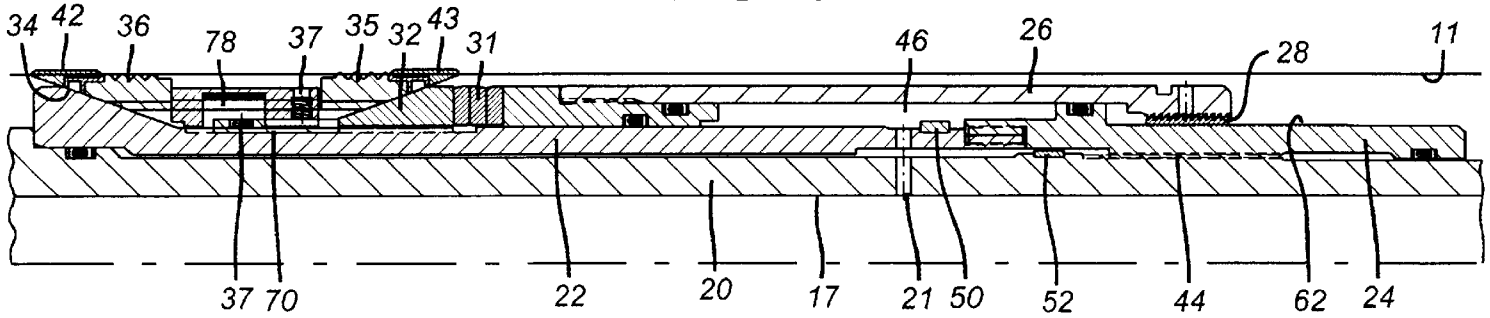
FIG. 6 is a half cylinder section of the invention at a fully deployed setting in a maximum casing bore.
Figure 7:
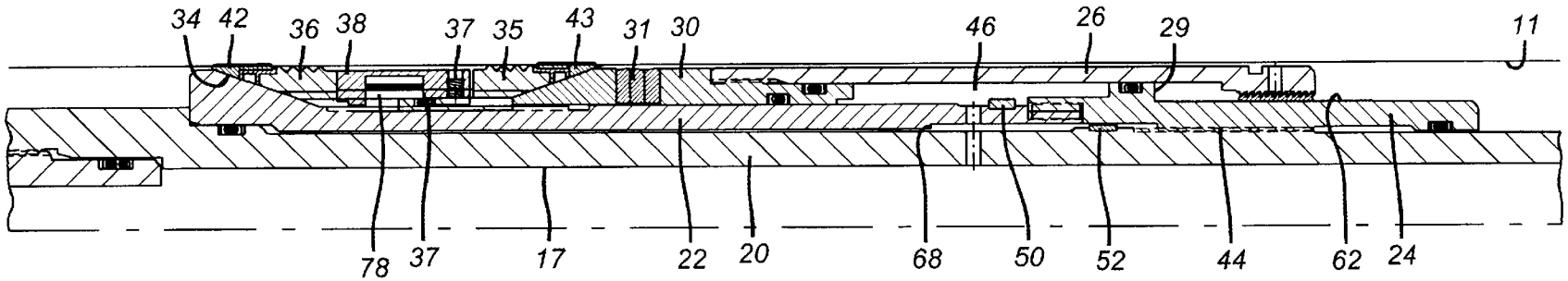
FIG. 7 is a half cylinder section of the invention at a fully deployed setting in a minimum casing bore; and, FIG. 8 is a half cylinder section of the invention at a fully retracted setting

As the upper wicker set 36 and upper packer seal 42 advances along the ramp of upper cone 34, the wicker 36 and seal 42 are also advanced radially against the internal casing wall 11 or borehole wall whichever may be the case. When the structural limit of radial displacement is reached, continued pressure increase within the chamber 46 imposes sufficient force on the screws 37 to shear the screw diameter. Shear failure of the screws 37 decouples the keys 70 from the cage 38 and permits the lower cone 32 to advance under the lower wicker set 35 as shown by FIGS. 6 and 7. Displacement of the lower cone 32 ramp under the lower wicker set 35 expands the lower wicker set and lower packer seal 43 against the casing wall 11 without releasing the seal or grip secured by the upper seal 42 or wicker set 36.

Figure 8:
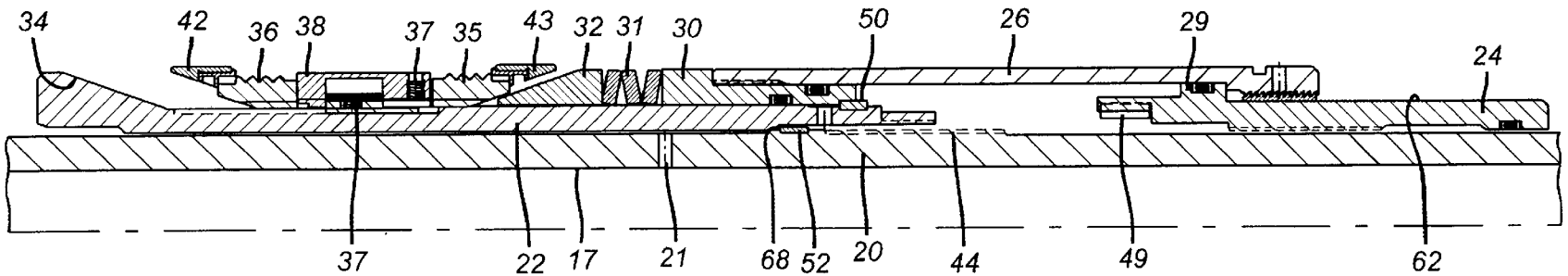

Release of the packer seal and slip structure from the associated casing or borehole wall is illustrated by FIG. 8. The upper tubing string 16 is simultaneously lifted and rotated. This surface controlled manipulation of the tubing string rotates the mandrel assembly threads 44 over those of the piston 24. Note that the keys 70 and slots 72 transmit rotational counter torque between the casing wall anchored slip wickers 35 and 36 to the tool body 22. The end spline joint 49 transmits torque countering force onto the piston 24. Hence, as the mandrel assembly threads are rotated against the piston 24 threads, the piston is displaced axially in the downhole direction. Continued rotation of the tubing string 16 advances the circumferential rib 29 of the piston 24 against the bottom end of the cylinder bore 26.

As the mandrel 20 is lifted against the wicker grip on the casing wall and the assembly thread 44 is rotated beyond relative engagement, the tool body 22 is released to slip axially along the mandrel 20 until the mandrel counterbore base 68 engages the inner pickup ring 52. Simultaneously, the inner edge of the push ring 30 engages the outer pickup ring 50. These pickup ring abutments prevent the assembly from being drawn axially further along the mandrel 20 and release the radial loads on the slip wickers 35 and 36. Due to the standing bias of the belt spring 39, the slips are extracted from the casing wall and returned to the retracted position.

In a non-illustrated, purely mechanical embodiment of the invention, the push ring 30 is advanced axially along a thread lead against the ring springs cone 32 by rotation of the tubing string 16. Distinctively, however, the vertical orientation of the invention is preferably reversed to dispose the rotational drive elements of the invention more proximate of the surface.

Although the present invention has been described in particular relation to the drawings attached hereto, it should be understood that other and further modifications, apart from those shown or suggested herein, may be made within the scope and spirit of the present invention. For example, those of ordinary skill in the art will recognize that a threaded screw mechanism may be substituted for the hydraulic fluid and piston mechanism described herein for forcibly displacing the sliding sleeve member 32.

We claim:

1. A downhole well tool comprising: a tubular mandrel that is substantially circumscribed by a tubular tool body, said mandrel and tool body being relatively rotatable; a unitized assembly of well sealing and setting elements disposed about a perimeter of said tool body, said sealing and setting elements of said tool having first and second radially displaced ramp surfaces, said first ramp surface being engaged by an axially displaced third ramp surface and said second radially displaced ramp surface being engaged by a cooperative forth ramp surface, said fourth ramp surface being secured to said tool body, radial displacement of said first and second ramped surfaces causing said sealing and setting elements to operatively engage a well wall; a tubular piston element disposed about said mandrel having a threaded assembly therewith and a meshed assembly with said tool body; and, a cylinder element disposed about said piston element for axial displacement of said third ramp surface.

2. A downhole well tool as described by claim 1 wherein said axially displaced ramp surface is conical.

3. A downhole well tool as described by claim 2 wherein said setting elements are a plurality of wall gripping units distributed around the circumference of said tool body and constrictively engaged by an elastomeric ring.

4. A downhole tool as described by claim 3 wherein said elastomeric ring includes said sealing elements.

5. A downhole tool as described by claim 4 wherein said cylinder element is axially displaced in a first direction by fluid pressure and in a second direction by axial translation of said mandrel.

6. A downhole tool as described by claim 5 wherein said piston element is advanced along an assembly thread lead until disengaged from said tool body.

7. A downhole tool as described by claim 5 wherein the axial translation of said mandrel abuts said cylinder element to said piston element whereby said push ring is retracted from said sliding sleeve.

8. A downhole well tool comprising: a tubular mandrel adapted to be operatively connected to a rotatively driven well string having a fluid flow conduit therein; a tool body coaxially disposed about said mandrel having a substantially cylindrical first outer surface length and substantially conical second outer surface length; a sliding sleeve disposed substantially coaxially around a portion of said tool body first surface, said sliding sleeve having a substantially conical outer surface; a plurality of elongated slip members disposed longitudinally around said tool body between said first surface and said sliding sleeve conical surface; and, a push ring disposed about said tool body for forcibly displacing said sliding sleeve against said slip members in response to fluid pressure within said fluid flow conduit, said push ring having a threaded linkage to said mandrel for retraction from said sliding sleeve by rotation of said well string.

9. A downhole well tool as described by claim 8 wherein said tool body is relatively rotatable about said mandrel.

10. A downhole tool as described by claim 9 wherein said threaded linkage comprises an annular piston having a threaded assembly with said mandrel, said annular piston having a unidirectional abutment with said sliding sleeve.

* * * * *